United States Patent [19]

Stäb et al.

[11] Patent Number: 4,817,932

[45] Date of Patent: Apr. 4, 1989

[54] GUIDE DEVICE

[75] Inventors: Rudolf Stäb, Frankenthal; Hans-Peter Sonnenberg, Altrip, both of Fed. Rep. of Germany

[73] Assignee: Albert-Frankenthal AG, Frankenthal, Fed. Rep. of Germany

[21] Appl. No.: 151,024

[22] Filed: Feb. 1, 1988

[30] Foreign Application Priority Data

Feb. 19, 1987 [DE] Fed. Rep. of Germany ..... 3705195

[51] Int. Cl.[4] ..... B41C 1/04

[52] U.S. Cl. ..... 270/47; 493/424; 271/69

[58] Field of Search ..... 270/46, 47, 49, 50, 270/54, 60, 21.1; 493/424–426, 428, 429, 432, 359, 360; 271/69

[56] References Cited

U.S. PATENT DOCUMENTS

| | | | |
|---|---|---|---|
| 2,131,363 | 9/1938 | Barber | 270/47 |
| 4,666,139 | 5/1987 | Filewich | 270/54 |
| 4,697,805 | 10/1987 | Herb | 270/47 |

FOREIGN PATENT DOCUMENTS

| | | | |
|---|---|---|---|
| 0197477 | 10/1986 | European Pat. Off. | 270/47 |

*Primary Examiner*—Robert E. Garrett

*Assistant Examiner*—Therese M. Newholm

*Attorney, Agent, or Firm*—Collard, Roe & Galgano

[57] ABSTRACT

In the context of a guide device for a narrowing gap between the two cylinders of a machine for processing sheet-like products, adapted to cooperate with each other during the transfer of the sheet-like products comprising a rotary member which is rotatably bearinged by means of lateral journals with an axis parallel to the cylinder and has a cylindrical outer surface, and at least one stationary connection member which is laterally adjacent to the said rotary member and has a surface configuration tangentially intersecting with a cylindrical outer surface of the rotary member, and in the case of which the rotary member and each connection member associated therewith are arranged so as to be adjustable in relation to the adjacent cylinders, a greater ease of operation is achieved inasfar as on at least one of the lateral journals of the rotary member, which is able to be moved by means of a setting device along an associated guide running sideways in relation to the axis of the rotary member, there is for each connection member at least one pivoting arm pivoted on the same and on such pivoting arm a carrier for the associated connection member is pivotally carried, which carrier is in pivotally firm connection with an associated sliding guide device.

18 Claims, 3 Drawing Sheets

GUIDE DEVICE

BACKGROUND OF THE INVENTION

Figure 1:
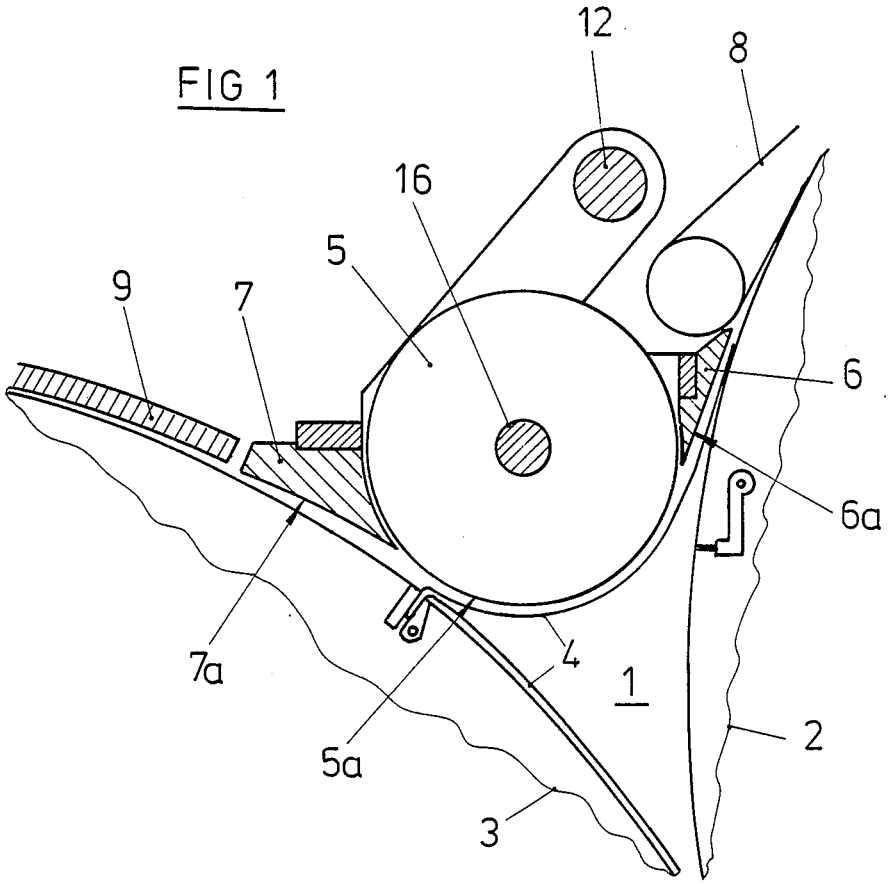

The present invention relates to a guide device for a narrowing gap between the two cylinders of a folder or the like which cooperate with each other during the transfer of sheet-like products comprising a rotary member which is rotatably bearinged by means of lateral journals with an axis parallel to the cylinder and has a cylindrical outer surface, and at least one stationary connection member which is laterally adjacent to the said rotary member and has a surface configuration tangentially intersecting with the cylindrical outer surface of the rotary member, and in the case of which the rotary member and each connection member associated therewith is arranged so as to be adjustable in relation to the adjacent cylinders.

An arrangement of this type is described in the U.S. Pat. No. 4,697,805 in which there is admittedly a discussion of the possibility of mounting the rotary member and each connection member adjustably on a frame. However the working example described in the specification shows a stationary arrangement and does not give any details as to how adjustability is to be provided for. The adjustability of the rotary member and of the connection members is however desired in many cases in order to be able to alter the position of the supporting surfaces of the rotary member and of the connection members in a way dependent on the thickness of the paper, the number of pages, the length of the paper format etc. in the folded products being handled in order to avoid so-called bashed corners or the like. In this regard it is an advantage if the tangential alignment of the connection members in relation to the rotary member and to the adjacent guide elements is ensured. In the event of individual adjustment of the rotary member of the connection members a relatively complex adjusting operation may thus be involved.

SHORT SUMMARY OF THE INVENTION

Taking this state of the art as a basis one object of the invention is thus to provide an arrangement of the initially stated type in which in the event of an adjustment of the rotary member each connection member is automatically entrained while maintaining its tangential alignment.

In order to achieve this or other objects in the present invention on at least one of the lateral journals of the rotary member, which is or are able to be moved by means of a setting device along an associated guide running sideways in relation to the axis of the rotary member, there is for each connection member at least one pivoting arm and on such pivoting arm a carrier for the associated connection member is pivotally carried, which carrier is in pivotally firm connection with an associated sliding guide device.

These measures make possible simple adjustment of the rotary member accompanied by a follow-up motion of each connection member while the equipment is in operation. Accordingly continuous adaptation of the position of the complete guide device is possible. With the aid of the sliding guide device and of the degree of freedom, present on the pivoting arm side, of each connection member it is in this respect readily possible to maintain the tangential alignment of each connection member in relation to the rotary member and to a guide element which may in some cases be provided adjacent to the respective connection member. There is the advantage that the rotary member is only set in the radial direction, something that greatly simplifies the adjusting device. The corresponding longitudnal guide may in this respect be best arranged so as to bisect the angle of the narrowing gap. The connection member or members are raised or lowered by the inherently stiff pivoting arms together with the rotary member, but n the other hand simultaneously experience a rotary motion imparted to them by the sliding guide device about their own axis so that in every position the tangential alignment in relation to the rotary member and each respectively adjacent guide element, for example one in the form of a belt guide, may be kept. Accordingly, in each position of the adjustable rotary member reliable operation is ensured.

In accordance with an advantageous further development of the invention it is possible for the adjusting device to have at least one pinion arranged on one journal and which s in mesh with a stationary rack and an opposite moving rack. Such feature ensures a very sturdy construction. It is convenient in this respect if the moving rack is threadedly connected with a setting screw borne on the frame This provides for a particularly sensitive possibility of adjustment.

As part of a further development of the invention the rotary member may have a continuous shaft, whose ends each form the journals, there being a pinion keyed on each journal so as to cooperate with a stationary rack. In the event of a setting motion taking pace there is then the advantage of strictly synchronous motion of the two journals and thus a precisely parallel adjustment of the rotary member. A further advantage of this form of the invention is to be seen in the fact that the two stationary racks may be relatively arranged with such an offset that the twisting of the shaft is allowed for. This thus leads to a high degree of accuracy.

A further feature of the invention is possible in which each carrier has two guide pins which have a mutual parallel offset, which fit into a respectively associated limb of the sliding guide device. This provides a simple way, that is to say with the aid of straight guide limbs, of causing a controlled translatory and pivotal motion of each connection member. The degree of the desired pivotal motion is then only dependent on the mutual slope of the two guide limbs and their slope in relation to the longitudinal guide on the rotary member. The possibility of employing straight guides also involves the advantage of an engagement of the guide pins over a large area and thus operation with a low wear rate. The guide pins thus only have to be arranged on the carrier member side with a degree of pivotal freedom in relation to their axis.

In accordance with a further advantageous feature of the invention one of the two guide pins provided for each carrier has its end opposite to the associated guide channel mounted on the adjacent pivoting arm. This leads to the benefit of a simple and compact design, since the continuous guide pin simultaneously serves as a amount means on the pivoting arm for the carrier through which t extends.

Further advantageous developments and convenient features of the invention will be gathered from the following account of one working example thereof referring to the accompanying drawings and to the claims.

LIST OF THE SEVERAL VIEWS OF THE DRAWINGS

FIG. 1. is a radial section taken through a multi-part guide of the type provided by the present invention.

Figure 2:
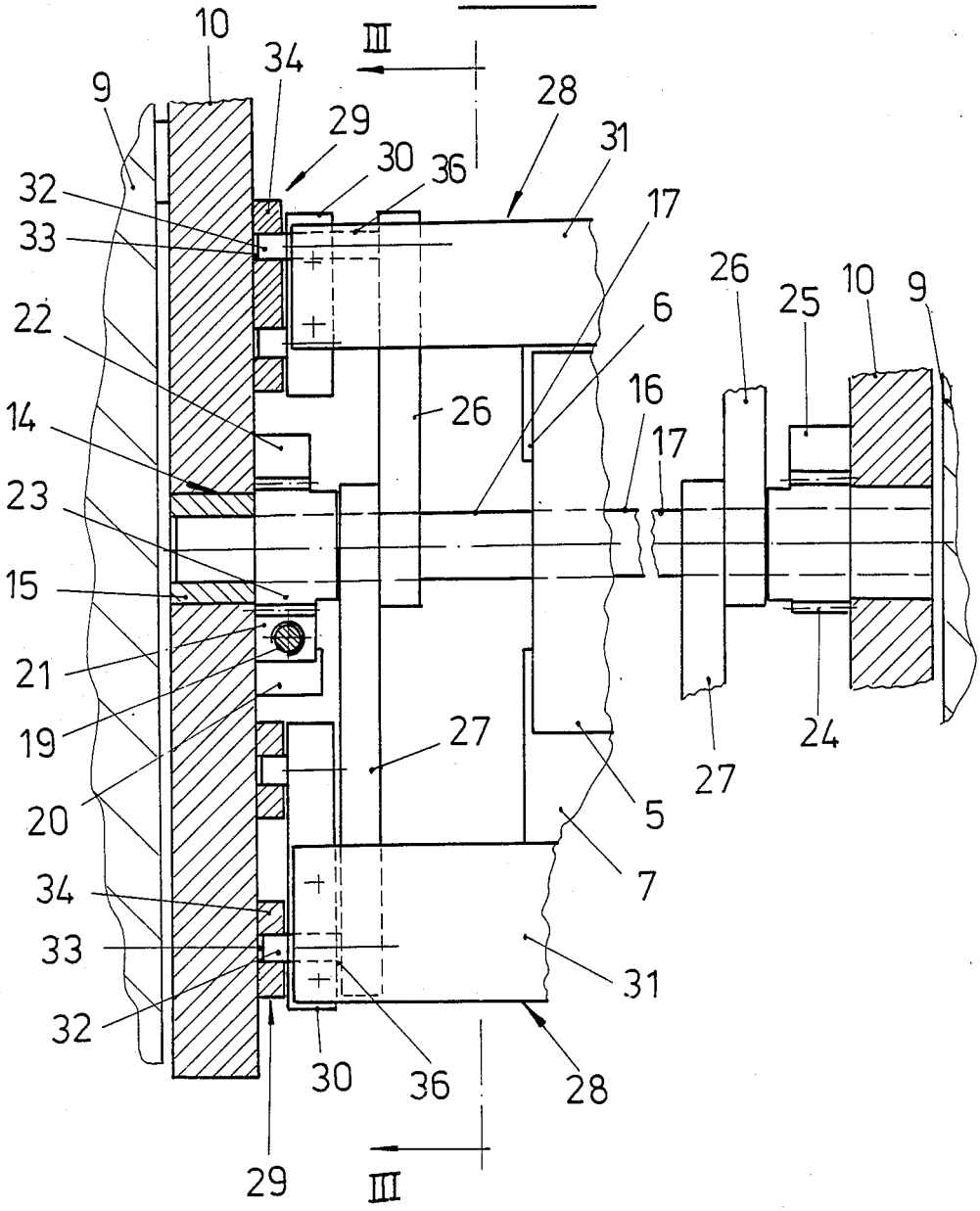

FIG. 2. is a view from above of the arrangement in accordance with FIG. 1 partly in section.

Figure 3:
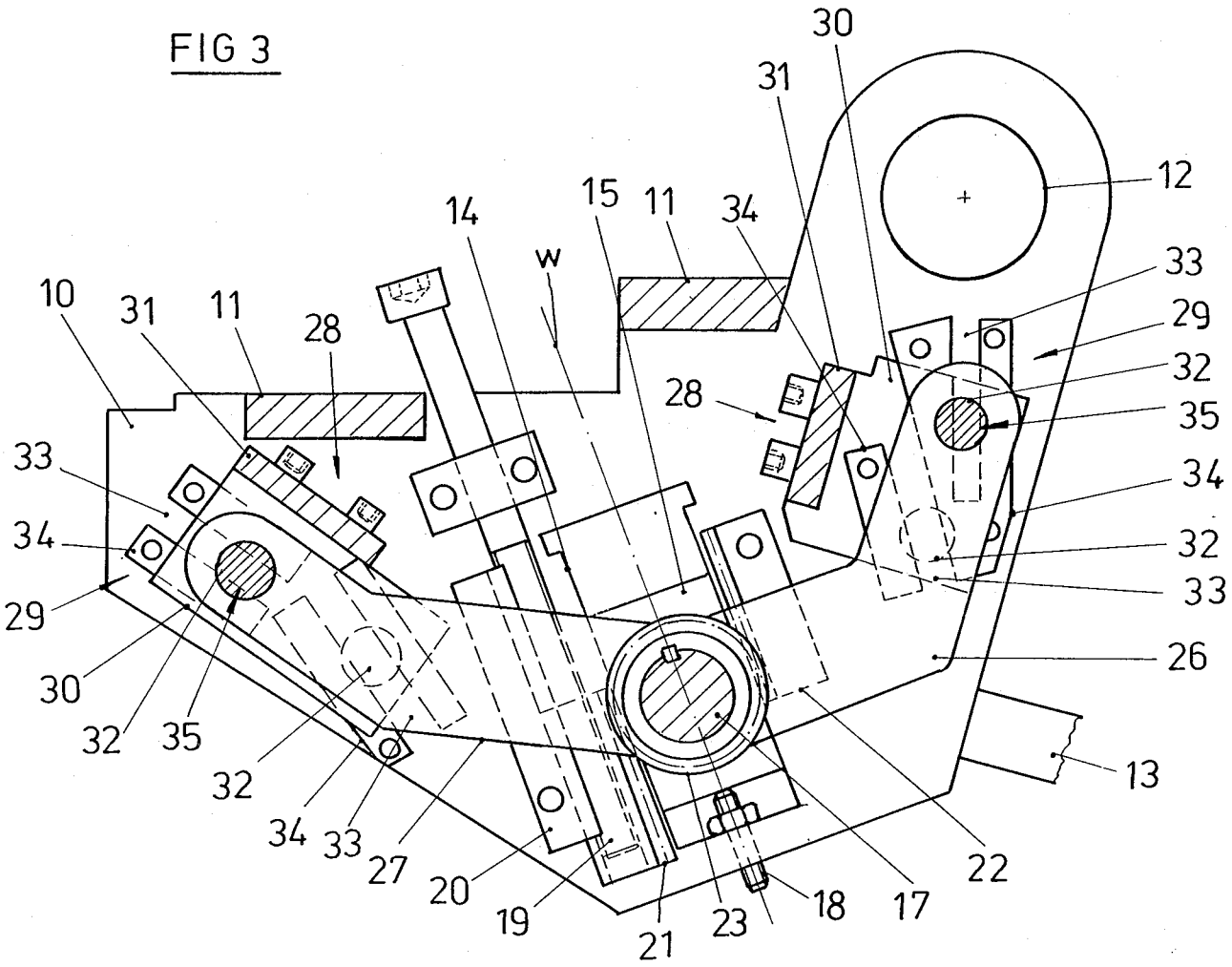

FIG. 3. is a section taken on the line III/III of FIG. 2.

DETAILED ACCOUNT OF WORKING EXAMPLE OF THE INVENTION

The guide device shown in FIG. 1 is associated with the narrowing gap 1 between a blade cylinder 2 and a folding jaw cylinder 3 of a folder and serves to feed the product half on the peripheral section, which during the folding operation is ahead on the folding blade on part of the periphery of the folding blade cylinder, of a folded product 4 to the folding jaw cylinder 3. The guide device shown here consists of a center rotary part 5 in the form of a freely rotatable roll or axially spaced coaxial freely rotatable rolls and connection members 6 and 7 which are laterally adjacent to the rotary member 5 and have a wedge-like cross section. Such connection members may be in the form of a continuous beam or of fingers mounted with or without any clearance between them on a crosspiece extending across the full width of the machine. The supporting surfaces 6*a* and, respectively, 7*a* of the connection members 6 and 7 on the one hand run generally tangentially into the cylindrical peripheral limit 5*a* of the rotary member 5 and adjoin on the other hand also tangentially or smoothly a respectively adjacent guide element, as in the case of the connection member 6, a guide belt 8 placed around the folding jaw cylinder 2 or, in the case of the connection member 7, a brush 9 placed around the folding jaw cylinder 3.

As best seen in FIG. 2 the rotary member 5 and the connection members 6 and, respectively, 7 are mounted on a frame able to be placed between the side walls or lateral bearing plates 10 of a folder having the folding jaw cylinder 2 and the folding blade cylinder 3. This frame is provided with lateral bearing plates 10, which as may best be seen from FIG. 3, are connected with each other securely by crosspieces 11 extending transversely thereto. The frame formed in this manner is pivotally arranged about the shaft 12 fixed to the folder in order to ensure that the guide device may be completely inactivated. In the operational state an abutment indicated in FIG. 3 may be used for locking.

In order to adapt the distance between the guide device formed by the rotary member 5 and the connection members 6 and 7, respectively, and the cylinders delimiting the associated narrowing gap 1 the rotary member 5 and the connection members 6 and, respectively, 7 are adjustably mounted on the lateral bearing plates 10. For this purpose the bearing plates 10, as may be seen form FIGS. 2 and 3, are provided with longitudinal guides 14, in the form of chamber-like recesses, arranged so as to bisect the angle subtended by the narrowing gap 1, and in each of which there is a sliding shoe 15 for supporting the rotary member. The rotary member 5 has a continuous shaft 16 in the embodiment shown, one which the casing having a peripheral limit 5*a* is rotatably mounted. The ends of the shaft 16 projecting beyond the casing form, as may be best seen from FIG. 2, lateral journals or trunnions 17 which are carried on respective sliding shoes 15. The lower initial position of the shoes 15 may, as will be seen from FIG. 3, be set by an adjustable abutment screw 18.

The adjustment of the sliding shoes 15 and thus of the rotary member 5 is undertaken, as will be seen from FIGS. 2 and 3, by means of a setting screw 19 which axially bears against one bearing plate 10 and has its head at a higher level than the associated frame so as to be readily accessible. This screw 19 makes screw threaded engagement with a rack 21 which is mounted for sliding motion in a longitudinal guide 20 fixed to the frame so as to be parallel to the longitudinal guide 14. The longitudinal guide 20 may be formed by a rail fitted around the rack 21 and attached to the adjacent bearing plate 10. The rack 21, which may be moved by the setting screw 19 along the guide 20, is engaged with a pinion 22 mounted on the adjacent journal 17 or trunnion, such pinion 22 simultaneously being in mesh with a stationary rack 23 opposite to the sliding rack and secured to the bearing plate 10.

In the embodiment of the invention illustrated the pinion 22, as may be seen from FIG. 3, is keyed onto the associated journal 17 and is locked in rotation with the continuous shaft 16 so that the latter is turned on operation of the sliding rack 21. In order to ensure a precisely parallel alignment of the rotary member 5 in relation to the axes of the cylinders 2 and 3 in every position, there is, as may be further seen from FIG. 2, a further keyed pinion 24 on the end opposite to the end of the shaft 16 having the pinion 23 thereon cooperating with the moving rack 21, such further pinion 24 meshing with a stationary rack 25 opposite to the stationary rack 22 so that the two journals 17 are equally moved on operation of the sliding rack 21. This second stationary rack 25 is arranged so that it may be adjusted in the longitudinal direction and as a result any out-of-phase condition occasioned by the twisting of the shaft 16 between the pinions 23 and 24 may be allowed for or corrected.

The connection members 6 and 7 are automatically moved in step with the rotary member 5 and controlled in such a manner that the tangential opening in the supporting outlines 6*a* and 7*a* in the peripheral outline 5*a* of the rotary member 5 and in the adjacent belt guide 8 or the brush 9 is maintained. For this purpose there is a pair of pivoting arms 26 and 27 inclined in relation to each other in the form of a letter V pivotally mounted on each of the two journals 17 and such arms make paired engagement with the ends of a carrier 28 for a connection member 6 or 7, respectively. The carriers 28 are mounted in the associated pivoting arms 26 and 27 with a degree of pivoting freedom. In order to prevent irregular pivoting motion of the carriers 28 in relation to the pivoting arms 26 and to ensure precise motion of the carriers 28 and thus of the associated connection members 6 and 7 along a given path of motion, the carriers 28 are in translatory engagement with sliding guides 29 dictating the desired path of movement with a secure pivotal guidance.

The carriers are generally in the form f bails and, as will be seen from FIGS. 2 and 3, consist of lateral bearer flanges 30, which are connected together by means of crosspieces 31, extending perpendicularly thereto and on which the connection members 6 and 7, respectively, may be attached. The bearer flanges 30 are each provided with two parallel offset guides pins 32, which project on the bearing plate side and which fit into a respectively associated limb of the associated sliding guide 29. Each sliding guide 29 is accordingly provided with two guide channels 33 associated with the two associated guide pins 32. As will best be seen from FIG. 3, these channels 33 are straight and inclined in relation to the direction of the longitudinal guide 14 associated with the rotary member 5. It is sufficient if adjacent to the end of one respective end of the carriers 28 there is one sliding guide 29 of the above described type. In order to ensure a high degree of accuracy it is however also possible to provide a sliding guides 28 at both ends of the carriers 28. This same applies in principle also for the pivoting arms 26 and 27, respectively, of which, unlike the case of the design shown with a paired arrangement of pivoting arms only one pivoting arm 26 or 27 is absolutely essential for each carrier 28. The guide channels 33 may be in the form of grooves milled into the bearing plates 10. In the illustrated example of the invention the guide channels 33 are delimited by rails 34 mounted on the bearing plates 10. If the guide channels 33 do not overlap lengthwise, it is possible to have single rails for this purpose, as is indicated at the bottom in FIG. 2 and on the left in FIG. 3. If the guide channels 33 overlap lengthwise, as is indicated at the top of FIG. 2 and on the right in FIG. 3 for the sliding guide of the connection member 6, it is possible to have shaped members each with a number of flanks defining channels 33.

The carriers 28 are pivotally mounted on the respectively associated pivot arms 26 and, respectively, 27, such arms for their part being able to be rocked in relation to the journals 17.

The pivot arms 26 and 27, respectively function accordingly as rigid spacers for the carriers 28 in one sliding guide 29. The parallel offset guide pins 32 provided for each carrier side and which fit into a respective associated guide channel 33 of the sliding guide 29 then provide a two-point attachment of the carriers 28 and thus make possible a conversion of the translatory motion able to be transmitted by the rigid pivot arms into a modified overall motion of the carriers 28. Owing to the two-point attachment provided in the present case it possible for mutually different motion of the front and rear parts of the respective connection members 6 and 7, respectively, to be produced together with practically any desired overall motion of the connection members 6 and 7. The position of the edge of the connection members 6 and 7 adjacent to the rotary member is so altered on adjustment of the rotary member 5 that a tangential opening remains. At the same time the position of the opposite edge is so changed that a tangential opening into the adjacent stationary guide element is generally maintained. It is thus not sufficient simply to displace the connection members 6 and 7 and the same have to perform an additional pivotal motion. Accordingly the guide channels 33 which dictate the form of the front and rear connection member edge and associated with each carrier 28, have different directions. The overall motion of the connection members 6 and 7, respectively, is thus made up of a translatory motion and a rotary one, the former taking place dependent on the translatory motion of the rotary member 5 along the bisecting line, marked in broken lines in FIG. 3, and the rotary motion dependent on the mutual inclination, which is present in relation to the bisecting line w, of the guide channels 33 and the translatory motion. The slope of the guide channels 33 naturally has to be so selected that there is no self-braking action, this being made possible by a suitable positioning of the guide pins 32. The later are so positioned accordingly that the plane containing their axis and the axis of the journals 17 is inclined in relation to the plane containing the bisecting line w and passing through the axis of the journals 17 so that there is the generally V-like arrangement as shown in FIG. 3, of the pivot arms 26 and 27.

The guide pins 32 may be rigidly mounted on the respectively associated bearer flange 30. In this case the guide pins 32 require a degree of pivotal freedom in the associated guide channel 33. In the illustrated design the guide pins are to be carried in the respectively associated bearer flange 30 with a degree of rotational freedom. The guide pins 32 may accordingly have flat side sliding faces 35 at the point of their engagement with the respectively associated guide channel, this ensuring a great resistance to wear. The carriers 28 are pivotally mounted by means of pins 36 on the associated pivot arms 26 and 27, respectively. Owing to the degree of rotational freedom here provided for of the guide pins 32 in relation to the bearer flanges 30 the design of the journals 36 is best such that one of the parallel offset guide pins 32, of which one is provided for each carrier 28, extends through the respective bearer flange 30 of the respective carrier and is held in the adjacent pivot arm 26 or 27, respectively.

We claim:

1. A guide device for a narrowing gap between the two cylinders of a machine for processing sheet-like products, adapted to cooperate with each other during the transfer of the sheet-like products comprising a rotary member which is rotatably supported by means of lateral journals with an axis parallel to the cylinders and has a cylindrical outer surface, and at least one stationary connection member which is laterally adjacent to the aid rotary member and has a surface configuration tangentially intersecting with the cylindrical outer surface of the rotary member, and in the case of which the rotary member and each connection member associated therewith are arranged so as to be adjustable in relation to the adjacent cylinders, wherein on at least one of the lateral journals of the rotary member, which is able to be moved by means of a setting device along an associated guide running sideways in relation to the axis of the rotary member, there is for each connection member at least one pivoting arm pivoted on the same and on such pivoting arm a carrier for the associated connection member is pivotally carried, which carrier is in pivotally firm connection with an associated sliding guide device.

2. The guide device as claimed in claim 1 wherein the lateral journals are respectively mounted on sliding shoes arranged in longitudinal guide means fixed to a frame of such machine.

3. The guide device as claimed in claim 2 comprising a respective adjustable abutment for limiting motion of the shoes.

4. The guide device as claimed in claim 1 wherein said setting device comprises at least one pinion mounted on one of said journals, a stationary rack and an opposite movable rack both in meshing engagement with said pinion.

5. The guide device as claimed in claim 4 comprising a setting screw, secured to the machine frame, threadingly engaging the movable rack.

6. the guide device as claimed in claim 4 comprising longitudinal guide means secured to said frame and in which said movable rack is contained.

7. The guide device as claimed in claim 4 comprising a continuous shaft on which said rotary member is mounted, ends of said shaft forming said journals, a pinion key on each journal and a stationary rack in mesh with said pinion.

8. The guide device as claimed in claim 7 wherein at least one of said stationary racks is able to be adjusted in its length direction.

9. The guide device as claimed in claim 2 wherein the longitudinal guide associated with said rotary member is arranged so as bisect the angle of said narrowing gap.

10. The guide device as claimed in claim 1 wherein each carrier has two parallel offset guide pins fitting into a respectively associated guide channel of said sliding guide device.

11. The guide device as claimed in claim10 wherein the guide channels associated with the two guide pins have an individual configuration which is preferably straight and is independent of the form of the longitudinal guides associated with the rotary member.

12. The guide device as claimed in claim 11 wherein the guide channels are delimited by spaced rails adapted to be mounted on the frame of the machine.

13. The guide device as claimed in claim 10 wherein the guide pins are provided with flat guide surfaces and on the carrier side are provided with a degree of pivotal freedom.

14. The guide device as claimed in claim 10 wherein one of the two guide pins provided for each carrier has an end thereof opposite to the associated guide channel in the form of a bearing pin accepted in the adjacent pivoting arm.

15. The guide device as claimed in claim1 wherein each plane containing a guide pin and the journals is inclined at an acute angle in relation to a median longitudinal plane of the narrowing gap.

16. The guide device as claimed in claim 1 wherein each carrier comprises two bearer flanges connected by at least one crosspiece and pivotally mounted on parallel pivot arms and preferably both bearer flanges are provided with mutually aligned guide pins.

17. The guide device as claimed in claim 1 comprising a frame having bearing plates preferably mounted in pivoting fashion on side frames of the machine, a crosspiece connecting such bearing plates together, such bearing plates having guide recesses to accept the said shoes, at least one bearing plate having guide channels for said guide pin.

18. The guide device as claimed in claim 1 wherein said machine is a folding machine.

* * * * *